US006766596B1

(12) United States Patent
Bienick et al.

(10) Patent No.: US 6,766,596 B1
(45) Date of Patent: Jul. 27, 2004

(54) APPLIANCE DOOR OR LID

(75) Inventors: Craig Bienick, Jenison, MI (US); Howard Daley, Zeeland, MI (US)

(73) Assignee: Gemtron Corporation, Sweetwater, TN (US)

( * ) Notice: Subject to any disclaimer, the term of this patent is extended or adjusted under 35 U.S.C. 154(b) by 0 days.

(21) Appl. No.: 10/617,718

(22) Filed: Jul. 14, 2003

(51) Int. Cl.[7] ..... F26B 11/02

(52) U.S. Cl. ..... 34/601; 34/602; 34/603; 68/12.01; 68/139

(58) Field of Search ..... 34/595, 601, 602, 34/603; 68/12.01, 139, 140; 312/408; 108/102

(56) References Cited

U.S. PATENT DOCUMENTS

| | | | | |
|---|---|---|---|---|
| 2,266,169 A | | 12/1941 | Crumrine | |
| 2,559,860 A | | 7/1951 | Fay | |
| 3,971,841 A | | 7/1976 | Rubinstein | |
| 4,626,185 A | | 12/1986 | Monnet | |
| 4,695,420 A | | 9/1987 | Grawey et al. | |
| 5,273,354 A | | 12/1993 | Herrmann et al. | |
| 5,362,145 A | | 11/1994 | Bird et al. | |
| 5,403,084 A | | 4/1995 | Kane et al. | |
| 5,429,433 A | | 7/1995 | Bird et al. | |
| 5,441,338 A | | 8/1995 | Kane et al. | |
| 5,454,638 A | | 10/1995 | Bird et al. | |
| 5,525,177 A | * | 6/1996 | Ross | 156/240 |
| 5,540,493 A | * | 7/1996 | Kane et al. | 312/408 |
| 5,676,894 A | | 10/1997 | Specht | |
| 5,735,589 A | * | 4/1998 | Herrmann et al. | 312/408 |
| 5,830,529 A | * | 11/1998 | Ross | 427/152 |
| 6,665,984 B2 | * | 12/2003 | Bienick et al. | 49/501 |

* cited by examiner

*Primary Examiner*—Ira S. Lazarus
*Assistant Examiner*—Kathryn S. O'Malley
(74) *Attorney, Agent, or Firm*—Diller, Ramik & Wight

(57) ABSTRACT

A door/lid for an appliance, such as a washer or dryer, includes a tempered glass panel upon an inner surface of which is applied one or two screen printed borders of fusible ceramic printing medium defining a substantially opaque peripheral border bounding a central viewing area through which clothing associated with a washer or dryer can be viewed when the door/lid is closed. An injection molded narrow encapsulation, border or rim surrounds an edge of the tempered glass panel and effects a water-tight seal therewith. Third ceramic printing means in the form of instructions or safety rules in applied to the first or second printing medium but is indiscernible from the outside when the door/lid is closed. When the door/lid is open, the instructions/safety rules are totally divisible, upright and readable.

34 Claims, 4 Drawing Sheets

FIG. 5
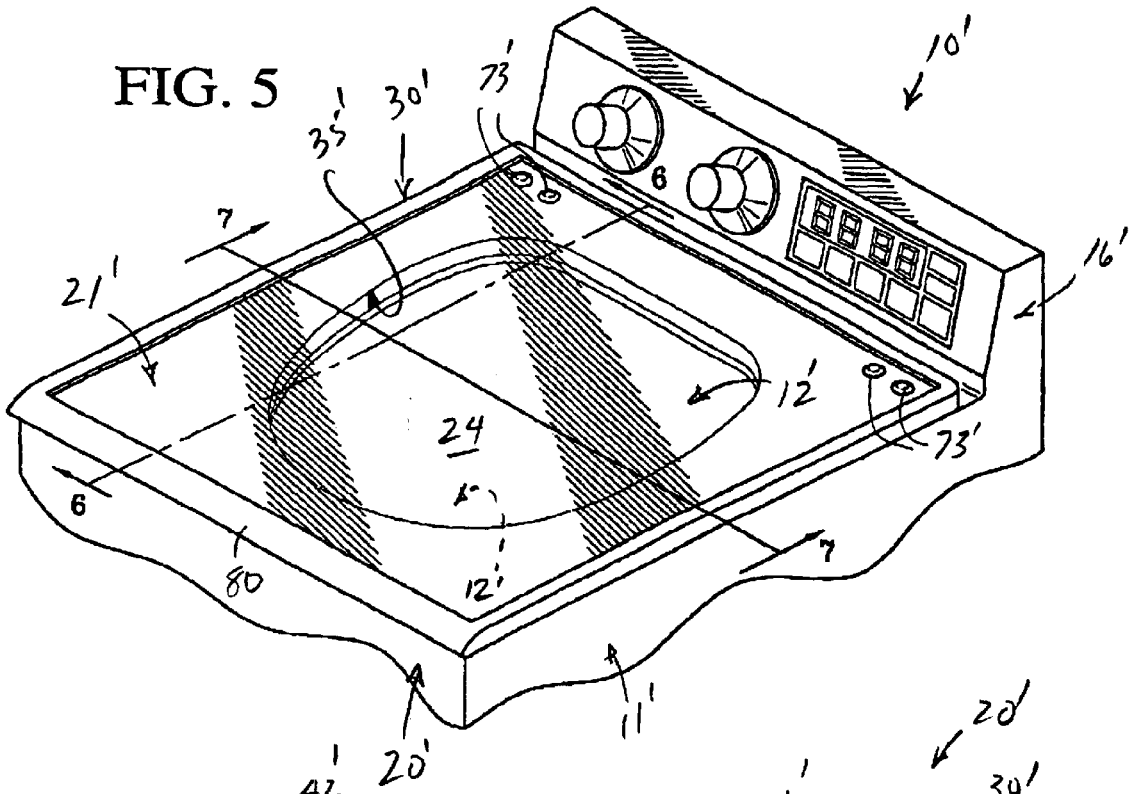
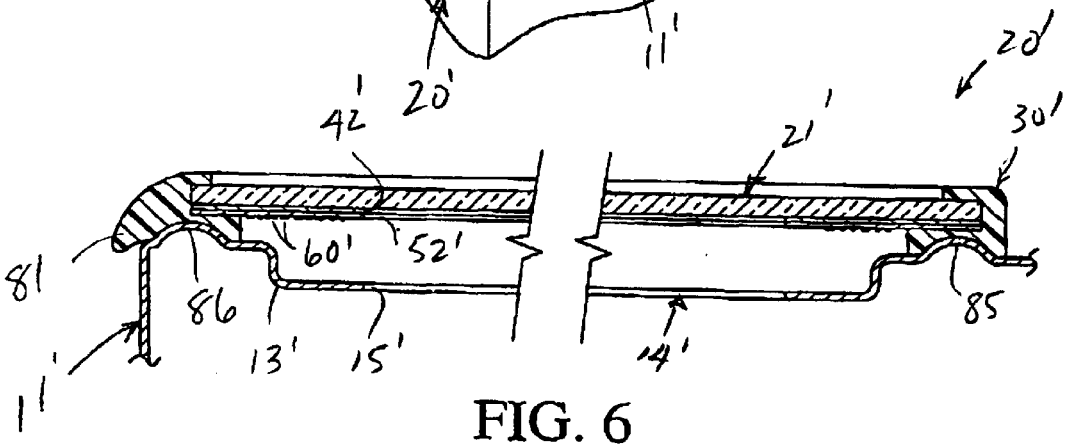
FIG. 6
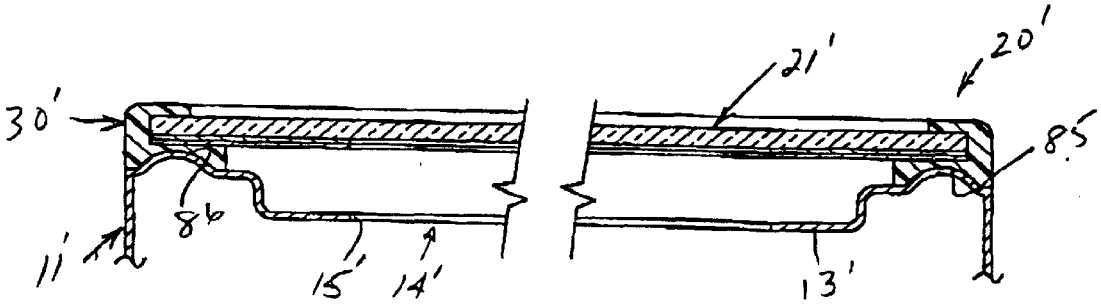
FIG. 7

APPLIANCE DOOR OR LID

BACKGROUND OF THE INVENTION

The invention is directed to a door or lid for an appliance, such as a clothes washer or clothes dryer, which is pivoted or hinged to a washer or dryer cabinet adjacent an opening through which clothing can be loaded or unloaded in a conventional top-loading or front-loading fashion. Conventionally, such doors or lids have been made of metal without or with a glass panel, and in the latter case the interior compartment of the washer or dryer and the contents therein could be viewed without opening the door or lid.

DESCRIPTION OF THE RELATED ART

Conventional washer and/or dryer lids or doors have for years been constructed from metallic material, generally sheet metal, which is generally cut into a number of pieces which are eventually assembled to each other. When the washer or dryer door or lid includes a tempered glass panel, fabrication and assembly of the various components, including the necessity of a door seal, become complex, cumbersome, time-consuming and expensive.

U.S. Pat. No. 4,695,420 granted on Sep. 22, 1987 and assigned to Caterpillar, Inc. makes reference to the desirability of injection-molding plastic articles having a variety of complex shaped and sizes including doors of vehicles, such as cab doors, which were originally manufactured by utilizing metal which is appropriately fabricated to form a door in which a window can be movable or movably mounted. Most often the window or glazing is floated in a soft gasket channel isolated from the frame to reduce shock-loads and thermal stresses induced by varying co-efficients of thermal expansion between the metal frame and the glazing or glass panel. The process disclosed in the latter patent is believed workable because the window panes in all cases are sheets of transparent plastic material, such as polycarbonate and acrylic, with the preferred material being a polycarbonate having a silicone hard coat applied thereto to make the polycarbonate glazing or window pane more scratch-resistant. The silicone hard coat on the peripheral edge is removed by sanding or grinding to assure good bonding between the eventually molded frame and the polycarbonate glazing.

With the advent of excellent molding qualities of modern plastic materials, an effort was made through efforts of the assignee of the present application to form a door by molding a frame, border or encapsulation of polymeric/copolymeric synthetic plastic material about the periphery of a transparent piece of tempered glass. The effort involved manufacturing a so-called "brown" appliance door, namely, a range oven door which in use is subject to relatively high temperatures. The latter is to be distinguishable from doors or lids for "white" appliances, such as washers or dryers, which are not subject to such relatively high temperatures. However, the commonality of doors/lids for both "white" and "brown" appliances was the past utilization of metal, particularly sheet metal frames made of many different pieces requiring separate formation, fabrication and assembly. Various pieces of such door frames are individually manufactured and are eventually assembled to a tempered piece of glass to provide a relatively limited viewing panel or window, and more often than not separate metallic connecting fasteners pass through opposing flanges of opposing frame members to form a unitized frame or shell bordering the glass panel. All of the latter is extremely time-consuming and costly.

Application Ser. No. 09/277,756 filed on Mar. 29, 1999 in the name of Craig Bienick discloses one solution toward manufacturing a relatively large peripherally encapsulated range oven door by placing tempered glass between heated mold bodies and depositing sheet molding compound (SMC) or bulk molding compound (BMC) about a periphery of an associated annular or peripheral mold cavity or chamber and outboard of a substantially continuous peripheral edge of the piece of tempered glass. The mold bodies are then progressively closed to thereby create compression forces upon the SMC/BMC which extrude the thermal-setting polymeric material into the annular chamber and into complete peripheral edge encapsulation of the continuous peripheral edge of the tempered glass, including opposite face surfaces and a peripheral edge surface therebetween. After curing the thermal-setting polymeric material under such heat and pressure, the mold bodies are opened and the peripherally encapsulated product (oven door) is removed.

The latter application describes the conventional practice of encapsulating a peripheral edge of glass through injection molding to manufacture lens mounts, as disclosed in U.S. Pat. No. 2,266,169 in the name of Chester W. Crumrine issued on Dec. 16, 1941. A lens element is clamped between two centering plungers which hold a lens with a peripheral edge thereof projecting into an annular cavity into which hot plastic is injected under pressure, cools and is subsequently removed from the mold cavity in the form of a lens mount.

Similar injection molding to form peripherally encapsulated pieces of glass are found in U.S. Pat. Nos. 2,559,860 and 3,971,841 issued to Howard G. Fay and Leon Rubinstein, respectively, on Jul. 10, 1951 and Jul. 27, 1966, respectively. Each of these two patents also relate to lens systems for photographic apparatus.

Larger pieces of glass have also been similarly provided with an injection-molded rim, encapsulation or frame, as in U.S. Pat. Nos. 4,626,185; 4,695,420 and 5,676,894 in the respective names of Bernard Monnet; Charles E. Grawey et al. and Paul Specht, which issued respectively on Dec. 2, 1986; Sep. 2, 1987 and Oct. 14, 1997. Such larger encapsulated glass structures are typically used as curved automobile glass panels, printed circuit boards, window panes, structural paneling and the like. The assignee of the present invention has expertise in the injection-molding encapsulation of tempered glass which is used primarily for shelving, particularly for refrigerators, as is evidenced by U.S. Pat. Nos. 5,273,354; 5,362,145; 5,403,084; 5,429,433; 5,441,338 and 5,454,638 issued respectively on Dec. 28, 1993; Nov. 8, 1994; Apr. 4, 1995; Jul. 4, 1995; Aug. 15, 1995 and Oct. 3, 1995, all assigned to the assignee of the present application.

Typically, such encapsulated shelves are manufactured in an injection mold which has been commonplace over the years and most typically includes two metallic cantilevered shelf brackets which are unitized to a piece of tempered glass by the injection-molded encapsulation, border or frame.

All of the latter products have no relevance to doors or lids, particularly utilized in conjunction with "white" appliances, such as dryers and washers, which possess unique requirements either through consumer demand or by state or federal law. For example, typical washer or dryer doors or lids include one or both of use instructions or safety precautions which typically are printed on the inside of such doors. When such doors or lids are constructed from metal and are painted and dried, it is relatively simple to print instructions and/or safety rules or precautions on the inner surfaces thereof, particularly when such doors or lids are devoid of a viewing opening closed by a relatively small panel of glass. Furthermore, since such doors/lids are conventionally manufactured from metallic material, securing hinges thereto is also relatively straightforward. However, numerous problems are presented when one attempts to manufacture relatively inexpensively, repetitiously and aesthetically "white" appliance doors or lids which are formed substantially entirely of a panel of tempered glass having a minor border of injection-molded material, while at the same time providing a viewing area which is less than the entire area of the piece of tempered glass, yet is sufficiently large to readily view clothing within the appliance compartment. The problem is compounded by the manner in which the door/lid can be attached to the associated dryer/washer and further compounded by applying on an inner surface thereof appropriate use instructions and/or personal safety rules which though viewable on the inside surface must necessarily not be viewable from the outside in order to create and maintain aesthetic appearances.

SUMMARY OF THE INVENTION

The present invention is specifically directed to a novel and unobvious door or lid for a "white" appliance, such as a washer or dryer, which is made from a relatively large piece of tempered glass having a periphery substantially the same size as and conforming to the associated panel of the washer or dryer to which it is hingedly attached. For example, if the door/lid is for a top-loading or a front-loading washer or dryer, its peripheral outline, area and size corresponds to the respective upper wall and front peripheral outline, area and size with each wall having an opening through which clothing is introduced into or removed from the appliance. Therefore, with such a door attached to the appliance, the relatively narrow frame of the door offers an aesthetic "border" to the peripheral edges of the top-loading or front-loading dryer/washer panels or walls.

Prior to injection molding the border, frame or encapsulation about the periphery of the tempered glass panel, the eventual inner or inside surface thereof is subjected to at least one and preferably two screen printing operations by which a heat-fusible printing medium/media is applied and adhered to the tempered glass panel inner surface. A first coating of the printing medium may be, for example, substantially opaque and cover or coat a peripheral portion of the inner surface of the tempered glass panel from the peripheral edge of the latter inboard to a relatively large unprinted area forming the view area of the door. This first coating is then subject to high temperatures (800° F.) fusion followed by cooling and the application over the first peripheral printed area of a second print medium which preferably is either another solid coating or a coating of thin closely spaced crossing lines typical of a window or door insect screen which, after fusing and cooling, imparts from the outside a similar screen-like appearance which is extremely aesthetic, though the second printing can simply be a second complete overcoat of the printing medium upon the first printing medium After the first single medium or both printing media have fused and cooled, the latter provide an inner surface upon which use instructions and/or personal safety rules can be printed, yet when printed thereupon, the same are not viewable or discernable when viewed from the outer surface of the door. For example, appropriate "WASHER INSTRUCTIONS" and "PERSONAL SAFETY RULES" can be applied by screen printing a third printing medium upon the first printing medium, if a second printing medium is not applied thereupon, or upon the second printing medium after which the third printing medium (INSTRUCTIONS/RULES) are subject to fusion (800° F.). The latter INSTRUCTIONS/RULES are appropriately applied to the inside of the door such that they are rendered upright and readable when the door is open, be it an upwardly opening door pivoting about a horizontal axis or a sidewise opening door pivoting or hinging about a vertical axis.

The door is also preferably connected by hinges, one in each corner, which are connected to holes formed in corners of the tempered glass panel which exteriorly are closed or covered by conventional fusible material which is of a color matching the border and the first and/or second screen-printing coatings or printings thereby blending with the latter. Preferably, there are two hinge holes formed in each corner of the tempered glass panel which are themselves each covered with matching fused bonding material, thus effecting an overall aesthetic door through a viewing window of which clothing is observable while only upon opening the door are appropriate INSTRUCTIONS/SAFETY RULES discernible and readable.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 5 is a fragmentary top-perspective view, and illustrates another appliance and a door pivotally connected thereto.

FIG. 6 is a fragmentary enlarged cross-sectional view taken generally along line 6—6 of FIG. 5, and illustrates a forward finger grip area of the encapsulation and a sealing or seating channel thereof of a concave configuration seating upon a convex seating or sealing peripheral wall outboard of an opening of the appliance cabinet.

FIG. 7 is an enlarged fragmentary cross-sectional view taken generally along line 7—7 of FIG. 5, and illustrates the cooperative seating of sides of the border and the cabinet convex seating opposite those shown in FIG. 6.

DETAILED DESCRIPTION OF THE INVENTION

Figure 1:
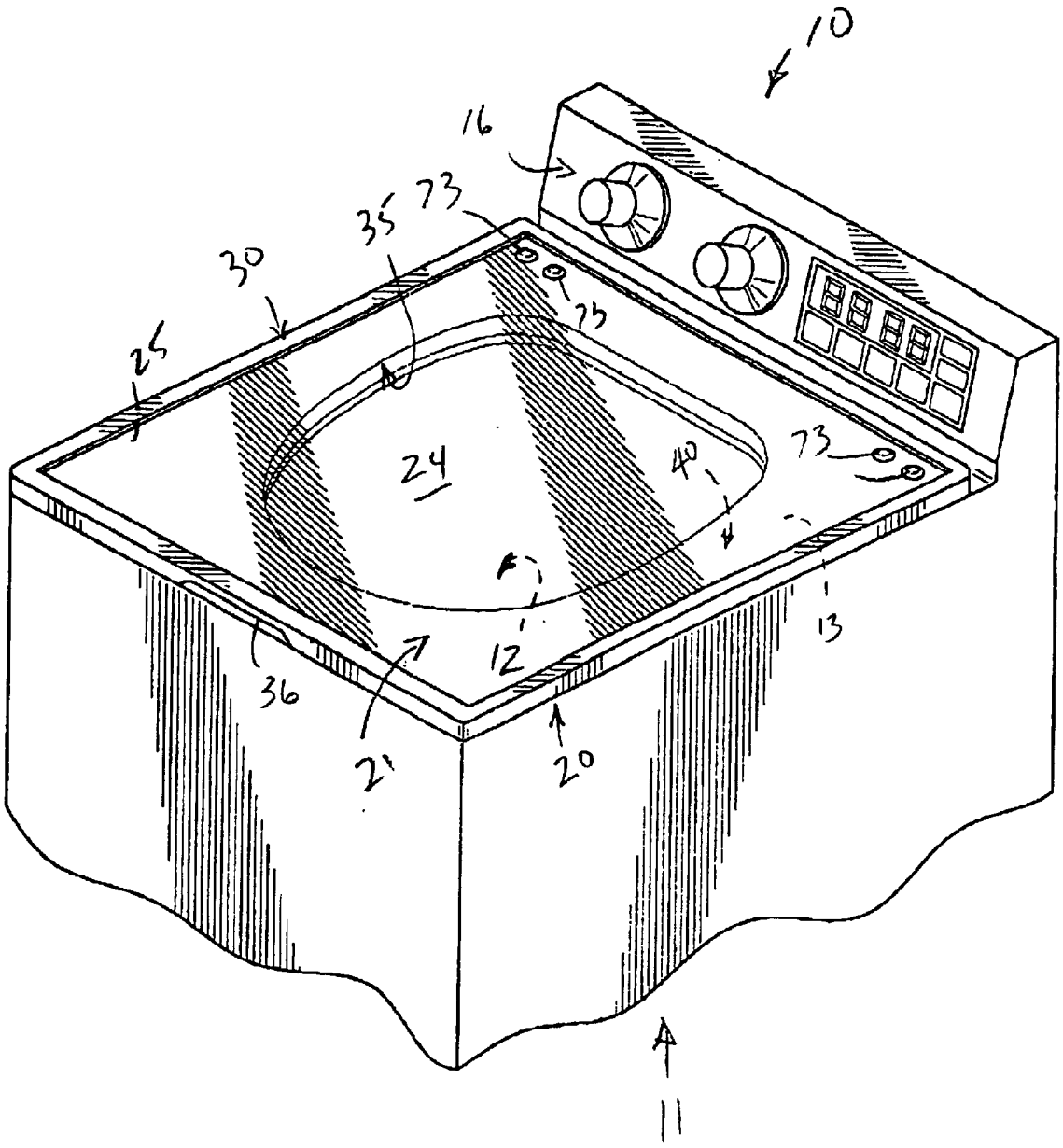
FIG. 1 is a fragmentary top perspective view, and illustrates a washer or dryer, a control panel thereof, and a door or lid in its closed position and being defined by a tempered glass panel bordered by an injection-molded rim, border or encapsulation and upon an inner surface of the glass panel, one or more coating which provide an opaque peripheral border of the glass panel and a central viewing area.
Figure 2:
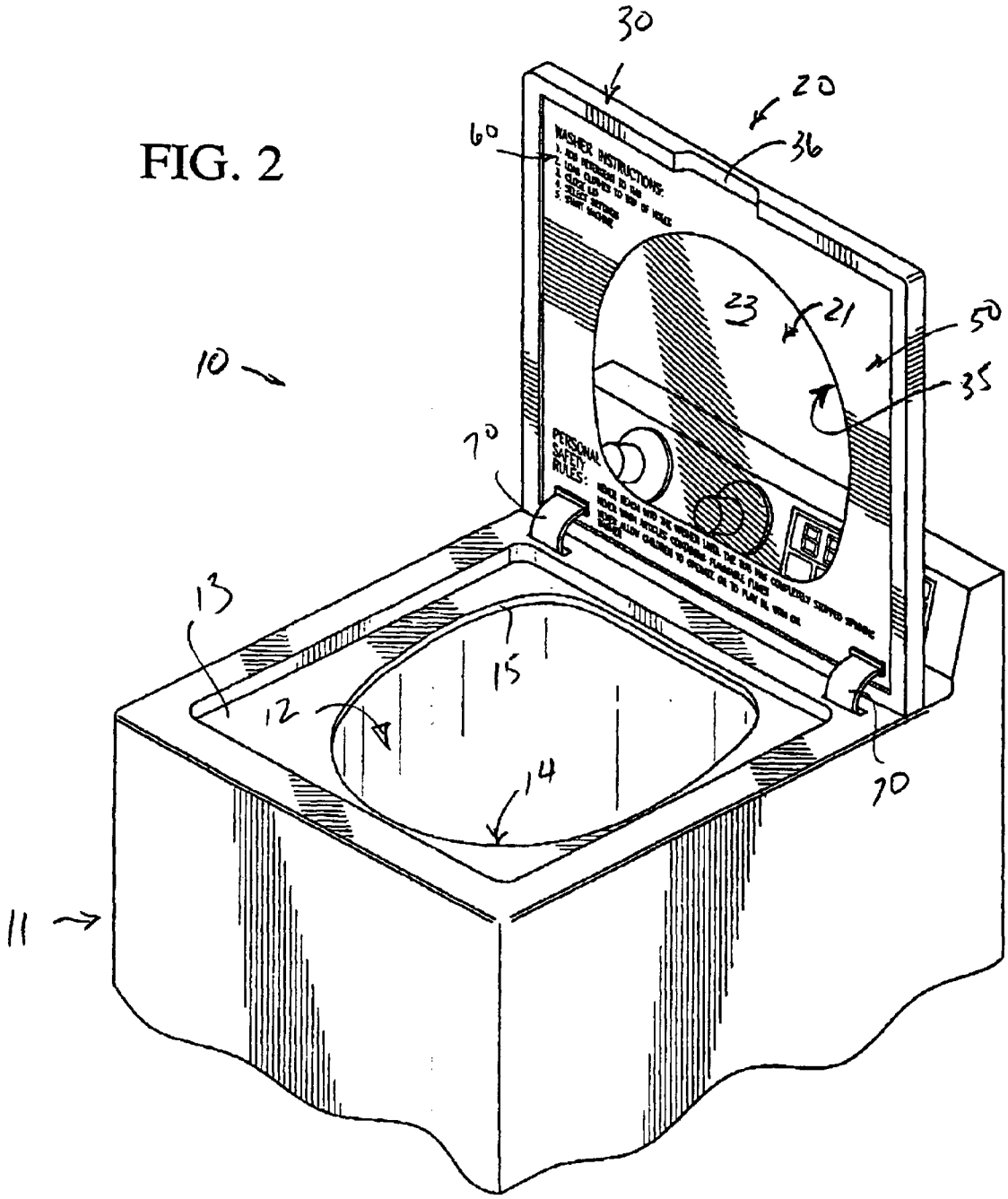
FIG. 2 is a fragmentary top perspective view, and illustrates the door/lid in an upper open position thereof, with the peripheral border having further a printing medium thereon in the form of instructions and/or safety rules viewable only when the door is open.

A novel "white" appliance constructed in accordance with this invention is illustrated in FIGS. 1 and 2 of the drawings and is generally designated by the reference numeral 10. The "white" appliance 10 is a washer or dryer and includes a conventional cabinet or body 11 having an interior chamber, compartment, drum or tub 12 which at its top is closed by a conventional top wall 13 having an opening 14 defined by a peripheral edge 15. The opening 14 can be of a variety of different sizes and shapes but must be sufficiently large to permit clothing to be easily deposited in or withdrawn from the compartment 12. A control panel 16 forms no part of the invention and is of a conventional construction, including all necessary dials, touch panels, etc. to control the operation of the washer or dryer 10.

A washer or dryer lid or door 20 constructed in accordance with this invention includes a tempered glass panel 21 (FIG. 4) of a predetermined peripheral configuration defined by a substantially continuous peripheral edge 22. The tempered glass panel 21 further includes opposite inner and outer surfaces 23, 24, respectively, bridged by the peripheral edge 22. A substantially polygonal, rectangular or square peripheral portion 25 of the tempered glass panel 21 is defined by the peripheral edge 22 and immediately adjacent surface portions of the opposite inner and outer surfaces 23, 24, respectively.

Figure 3:
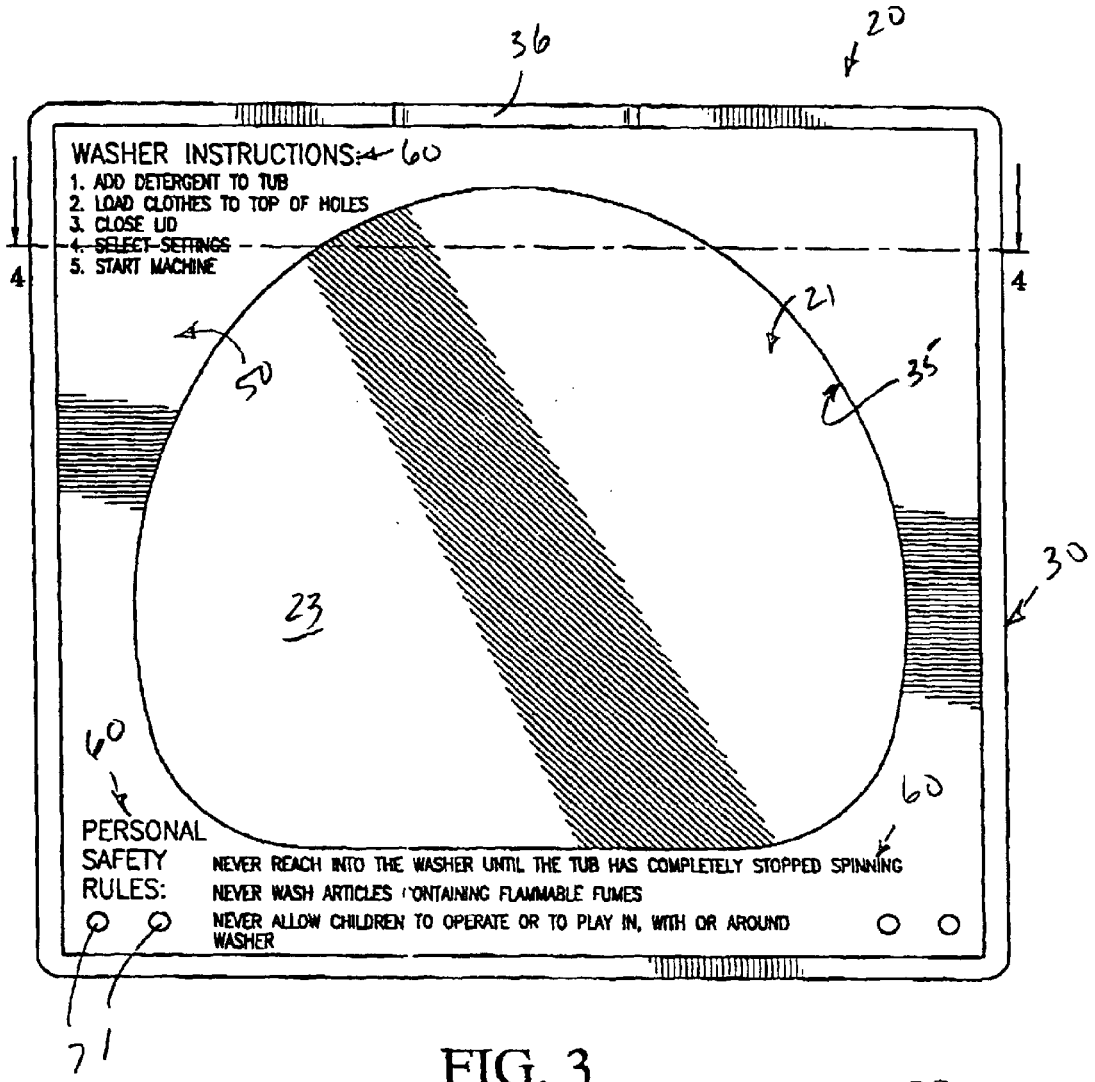
FIG. 3 is an enlarged elevational view of the inside of the door or lid of FIG. 2, and illustrates details thereof, including two openings in each corner of the tempered glass panel for pivotally or hingedly connecting the door to the appliance.
Figure 4:
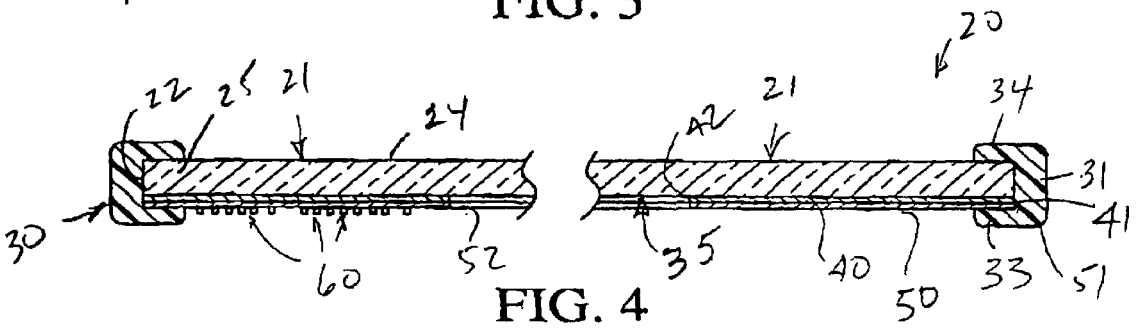
FIG. 4 is an enlarged fragmentary cross-sectional view taken generally along line 4—4 of FIG. 3, and illustrates details of the border encapsulating the glass panel and the print media applied thereto and in part defining the view area of the door.

An open frame-like rim, border or encapsulation 30 is formed as a one-piece injection molding of polymeric/copolymeric synthetic plastic material, has a relatively minor cross-section and is unitized to a vary minor peripheral area of the peripheral edge portion 25 of the tempered glass panel 21 (FIGS. 3 and 4).

The open frame-like encapsulation 30 includes an outer peripheral portion 31 (FIG. 4), an inner peripheral portion 33 and an outer peripheral portion 34 respectively adjacent the surfaces 23, 24 at the peripheral edge portion 25 of the tempered glass panel 21. Though the encapsulation 30 is injection molded upon the peripheral edge portion 25 of the tempered glass panel 21, such is not done until the inner surface 23 of the tempered glass panel 21 has applied thereto, preferably by stencil screen printing, a first printing medium 40, a second printing medium 50 and a third printing medium 60, all of which are preferably a ceramic printing medium heat fusible at approximately 800° F. or above.

The printing medium 40 ranges between substantially translucent to substantially opaque and is preferably substantially opaque and might be, for example, white if the overall color of the appliance 10 is white. The printing medium 40 defines a relatively narrow peripheral border having an outermost peripheral edge 41 (FIG. 4) which corresponds to the peripheral edge 22 of the tempered glass panel 21 and an innermost or inboard edge 42 defining a translucent central view area 35 which, of course, corresponds in size and shape to the opening 12 defined by the edge 15 and the top panel 13 of the appliance 10.

After the printing medium 40 has sufficiently cooled, the second printing medium 50 is overcoated thereupon, preferably by screen printing, either completely or decoratively in a manner which, when viewed from above in the closed position of the door 20 (FIG. 1) imparts a variation in tone or shade or translucence to the coatings 40, 50. As an example, the printing medium 50 can be applied upon the printing medium 40 in the form of substantially very opaque and very closely adjacent crossing lines, much in the manner of insect screening for doors and windows which, after fusion and cooling, appears from above as a series of very closely adjacent very opaque crossing lines against the continuous unbroken coating of the somewhat lesser opaque printing medium 40 thereby creating a regular "mottled" or "dotted" appearance even if the printing media are both white, namely, white-on-white. The printing medium 50 also includes an outboard or outermost peripheral edge 51 (FIG. 4) contiguous the edge 41 of the printing medium 40 and an innermost or inboard edge 52 which is contiguous the edge 42 of the printing medium 40 and defines therewith the translucent central viewing area 35 which, once again, corresponds to the opening 14 of the top panel 13 defined by the edge 15 thereof (FIG. 2). The printing media 60 is preferably any one or both of "WASHER INSTRUCTIONS" and "PERSONAL SAFETY RULES," as is reflected best in FIG. 3 of the drawings, with the lower unnumbered portion of the printing media 50 being of a sufficient size to accommodate the desired language, as is reflected by the three sentences each beginning "NEVER." The "WASHER INSTRUCTIONS" of the printing media 60 are more succinct and can be readily accommodated upon a corner portion (unnumbered) of the printing media 50. Obviously, the color of the printing media 60 is in contrast to that of the printing media 50 and/or 40, such as black which is readily visible against the white printing medium 50, but only when the door 20 is open (FIGS. 2 and 3).

It is only after the printing medium 60 has been fused and cooled that the tempered glass panel 21 with the fused printing media 40, 50, 60 thereon is placed in a mold and the border 30 is injection molded thereon fusing to the peripheral edge portion 25 of the tempered glass panel 21 and the edges 41, 51, as well as to an adjacent peripheral surface (unnumbered) of the printing medium 50.

As is most readily apparent from FIG. 1 of the drawings, in the closed position of the door 20, the medium 60 is totally indiscernible, yet is upright and readable upon the door 20 being opened (FIGS. 2 and 3), whether by means of upward pivoting movement (FIG. 1 to FIG. 2) or pivoting about a vertical axis (not shown) when the door 20 is associated with a front-loading washer or dryer (not shown). Since the border 30 is relatively narrow, a minor hand grip area or recess 36 is provided at a side thereof remote from metal hinges 70, 70 (FIG. 2) which are substantially identical and each includes bifurcated ends (not shown) which are introduced into pairs of openings 71, 71 at each of two corners of the tempered glass panel 21 and are adhesively bonded thereto by high strength glass-to-metal adhesive 73 which corresponds in color to the printing medium 40 and the border 30, which is preferably white.

From the foregoing, an extremely uncomplicated two-piece appliance door 20 is provided which is aesthetic, yet fulfills all necessary criteria including the presence of "INSTRUCTIONS/SAFETY RULES" 60 visible only when the door 20 is open (FIGS. 2 and 3) and totally invisible when the door 20 is closed (FIG. 1).

Another appliance constructed in accordance with this invention is illustrated in FIGS. 5 through 7 of the drawings and is generally designated by the reference numeral 10'. Primed reference characters have been applied to the appliance 10' to indicate structure identical to that of the appliance 10. The appliance 10' differs from the appliance 10 in two basic features, namely, in lieu of the finger grip recess 35 of the border 30 of the appliance 10, a border 30' of the appliance 10' has a front edge 80 which projects downwardly and outwardly (FIG. 6) beyond a front wall (unnumbered) of a cabinet 11' to permit a door 20' to be grasped and manipulated. Secondly, a lower surface of the border 30' includes a downwardly concavely opening seating and sealing recess 85 (FIGS. 6 and 7) which matches and seats upon a convexly upwardly curved seating or sealing surface 86 of an upper wall 13' of the appliance 10'. The latter is particularly advantageous when the appliance 10' is a washer because it provides a continuous peripheral seal to prevent the escape of water through the opening 14' and beyond the wall 86.

Each or all of the heat-fusible ceramic printing medium/media 40, 50 and 60 are preferably conventional ceramic ink/paint which is a composition of ground glass fragments (frit) pigments (color), flux (used to improve the melting of the frit), and medium (used to create a liquid conditin for silk screen or similar transfer). Once applied to the glass panel 21 (medium 40) or to each other (media 50 and 60), the ink/paint 40, 50, 60 are normally dried to remove the liquid transfer medium leaving a dried film, decoration, print or the like on the glass panel 21. Some ink/paint/medium/media are, however, formulated to remain wet up to the firing and/or tempering process.

Ceramic heat-fusible ink/paint/medium 40, 50 and/or 60 can be fired (melted) into the surface of the glass panel 21 by careful and controlled heating followed by careful and controlled cooling to achieve a low stress/annealed finished product. Tempering is another method to achieve firing of the ink/paint/media while adding strength to the glass. (Tempered glass is three to five times stronger than annealed glass.) Obviously, the ink/paint/media 40, 50, 60 are formulated to achieve desired color/colors, excellent abrasion, and chemical and impact resistance.

In lieu of the latter described ceramic heat-fusible medium, the media 40, 50 and 60 can instead be a urethane adhesive, such as BETASEAL® adhesives manufactured by The Dow Chemical Company which do not require heat, can be applied exclusively cold to the glass panel 21 and dry within an hour even in temperature extremes (0° to 115° F.) Typical of such BEATASEAL® adhesives are identified under the product numbers U-216, 3000HMNC, 1502 HMNC, U-400HV/U-400EP, U-418HV-U-418EP and U-418.

These adhesives are extremely strong and can also be utilized as the adhesive 73 for bonding the metal hinges 70, 70 (FIG. 2) to the pairs of openings 71, 71 at each of the two corners of the tempered glass panel 21.

Although a preferred embodiment of the invention has been specifically illustrated and described herein, it is to be understood that minor variations may be made in the apparatus without departing from the spirit and scope of the invention, as defined by the appended claims.

What is claimed is:

1. An appliance comprising a housing defining a compartment including a wall having an opening through which clothing can ingress and egress said compartment, at least one of a door and lid, hinge means for effecting movement of said at least one door and lid between a first position substantially closing said opening and a second position substantially effecting opening of said opening, said at least one door and lid including a panel of substantially transparent tempered glass having a peripheral edge portion bordered by a frame defined at least in part by a peripheral encapsulation of synthetic polymeric/copolymeric material, said frame including a peripherally innermost edge portion defined by upper and lower walls bridged by a peripheral wall collectively defining a channel housing said glass panel peripheral edge portion, said glass panel including an outer surface and an inner surface, a substantially central area and a peripheral area between said substantially central area and said peripheral encapsulation, means upon said glass panel inner surface of said peripheral area for imparting an appearance thereto ranging between substantially translucent to substantially opaque and establishing an edge defining an outer periphery of said substantially transparent central area through which the compartment and/or clothing therein can be viewed when said at least one door and lid is in the first position thereof, printing means in the form of at least one of clothing care instructions and safety directions upon at least an exposed surface portion of said appearance imparting means which are substantially indiscernible when viewed through said glass panel outer surface in said at least one door and lid first position, and said one of clothing care instructions and safety directions are readably oriented and readable in the at least one door and lid second position against the background afforded thereto by said appearance imparting means.

2. The appliance as defined in claim 1 including one of an upwardly and outwardly convexly curved peripheral seating wall portion outboard of and substantially surrounding said compartment wall opening, and said peripheral encapsulation lower wall includes one of a downwardly and inwardly concavely curved peripheral seating surface substantially mirroring the configuration of and seating upon said peripheral seating wall portion in said at least one door and lid first position.

3. The appliance as defined in claim 2 wherein said peripheral encapsulation includes at least two substantially opposite wall portions, one of said opposite wall portions includes a finger grip surface portion and said hinge means is located opposite said finger grip surface portion located outboard of said peripheral seating surface.

4. The appliance as defined in claim 2 wherein at least one of said appearance imparting means and said printing means are heat fusingly adhered to said respective glass panel inner surface and said appearance imparting means.

5. The appliance as defined in claim 2 wherein said appearance imparting means and said printing means are heat fusingly adhered to said respective glass panel inner surface and said appearance imparting means.

6. The appliance as defined in claim 2 wherein at least one of said appearance imparting means and said printing means are heat fusingly adhered to said respective glass panel inner surface and said appearance imparting means, and said at least one appearance imparting means and said printing means is a ceramic print medium.

7. The appliance as defined in claim 2 wherein said peripheral encapsulation includes a finger grip surface portion, and said hinge means is located opposite said finger grip surface portion.

8. The appliance as defined in claim 2 wherein said peripheral encapsulation includes at least two substantially opposite wall portions, one of said opposite wall portions includes said finger grip surface portion, and said hinge means is located opposite said finger grip surface portion.

9. The appliance as defined in claim 2 wherein said appearance imparting means and said printing means are heat fusingly adhered to said respective glass panel inner surface and said appearance imparting means, and said at least one appearance imparting means said printing means is a ceramic print medium.

10. The appliance as defined in claim 1 wherein said peripheral encapsulation includes at least two substantially opposite wall portions, one of said opposite wall portions includes a finger grip surface portion, and said hinge means is located opposite said finger grip surface portion.

11. The appliance as defined in claim 10 wherein at least one of said appearance imparting means and said printing means are heat fusingly adhered to said respective glass panel inner surface and said appearance imparting means.

12. The appliance as defined in claim 10 wherein said appearance imparting means and said printing means are heat fusingly adhered to said respective glass panel inner surface and said appearance imparting means.

13. The appliance as defined in claim 10 wherein at least one of said appearance imparting means and said printing means are heat fusingly adhered to said respective glass panel inner surface and said appearance imparting means, and said at least one appearance imparting means and said printing means is a ceramic print medium.

14. The appliance as defined in claim 1 wherein at least one of said appearance imparting means and said printing means are heat-fusingly adhered to said respective glass panel inner surface and said appearance imparting means.

15. The appliance as defined in claim 1 wherein said appearance imparting means and said printing means are heat fusingly adhered to said respective glass panel inner surface and said appearance imparting means.

16. The appliance as defined in claim 1 wherein at least one of said appearance imparting means and said printing means are heat fusingly adhered to said respective glass panel inner surface and said appearance imparting means, and said at least one appearance imparting means and said printing means is a ceramic print medium.

17. The appliance as defined in claim 1 wherein said appearance imparting means and said printing means are heat fusingly adhered to said respective glass panel inner surface and said appearance imparting means, and said at least one appearance imparting means said printing means is a ceramic print medium.

18. The appliance as defined in claim 1 wherein said hinge means define a substantially horizontally oriented hinge axis.

19. The appliance as defined in claim 1 wherein said hinge means define a substantially vertically oriented hinge axis.

20. An appliance comprising a housing defining a compartment including a wall having an opening through which clothing can ingress and egress said compartment, at least one of a door and lid, hinge means for effecting movement of said at least one door and lid between a first position substantially closing said opening and a second position substantially effecting opening of said opening, said at least one door and lid including a panel of substantially transparent tempered glass having a peripheral edge portion bordered by a frame defined at least in part by a peripheral encapsulation of synthetic polymeric/copolymeric material, said frame including a peripherally innermost edge portion defined by upper and lower walls bridged by a peripheral wall collectively defining a channel housing said glass panel peripheral edge portion, said glass panel including an outer surface and an inner surface, a substantially central area and a peripheral area between said substantially central area and said peripheral encapsulation, first means upon said glass panel inner surface of said peripheral area for imparting an appearance thereto ranging between substantially translucent to substantially opaque and establishing an edge defining an outer periphery of said substantially transparent central area through which the compartment and/or clothing therein can be viewed when said at least one door and lid is in the first position thereof, second means upon said first appearance imparting means for imparting additional appearance thereto, printing means in the form of at least one of clothing care instructions and safety directions upon at least an exposed surface portion of said second appearance imparting means which are substantially indiscernible when viewed through said glass panel outer surface in said at least one door and lid first position, and said one of clothing care instructions and safety directions are readably oriented and readable in the at least one door and lid second position against the background afforded thereto by said first and second appearance imparting means.

21. The appliance as defined in claim 20 including one of an upwardly and outwardly convexly curved peripheral seating wall portion outboard of and substantially surrounding said compartment wall opening, and said peripheral encapsulation lower wall includes one of a downwardly and inwardly concavely curved peripheral seating surface substantially mirroring the configuration of and seating upon said peripheral seating wall portion in said at least one door and lid first position.

22. The appliance as defined in claim 21 wherein said hinge means define a substantially horizontally oriented hinge axis.

23. The appliance as defined in claim 21 wherein said hinge means define a substantially vertically oriented hinge axis.

24. The appliance as defined in claim 21 wherein said peripheral encapsulation includes at least two substantially opposite wall portions, one of said opposite wall portions includes a finger grip surface portion, and said hinge means is located opposite said finger grip surface portion.

25. The appliance as defined in claim 20 wherein said peripheral encapsulation includes at least a finger grip surface portion, and said hinge means is located opposite said finger grip surface portion.

26. The appliance as defined in claim 20 wherein said first and second appearance imparting means and said printing means are heat-fusingly adhered to said respective glass panel inner surface, said first appearance imparting means and said second appearance imparting means.

27. The appliance as defined in claim 20 wherein said first and second appearance imparting means and said printing means are heat-fusingly adhered to said respective glass panel inner surface, said first appearance imparting means and said second appearance imparting means, and at least one of said first and second appearance imparting means and said printing means is a ceramic print medium.

28. The appliance as defined in claim 20 wherein said first and second appearance imparting means and said printing means are heat-fusingly adhered to said respective glass panel inner surface, said first appearance imparting means and said second appearance imparting means, and said first and second appearance imparting means and said printing means are a ceramic print medium.

29. An appliance door/lid comprising a panel of substantially transparent tempered glass having a peripheral edge portion bordered by a frame defined at least in part by a peripheral encapsulation of synthetic polymeric/copolymeric material, said frame including a peripherally innermost edge portion defined by upper and lower walls bridged by a peripheral wall collectively defining a channel housing said glass panel peripheral edge portion, said glass panel including an outer surface and an inner surface, a substantially central areas and a peripheral area between said substantially central area and said peripheral encapsulation; means upon said glass panel inner surface of said peripheral area for imparting an appearance thereto ranging between substantially translucent to substantially opaque and establishing an edge defining an outer periphery of said substantially transparent central area through which clothing can be viewed when said door/lid is in a closed position with respect to a clothes opening of an associated appliance, printing means in the form of at least one of clothing care instructions and safety directions upon at least an exposed surface portion of said appearance imparting means which are substantially indiscernible when viewed through said glass panel outer surface in said closed position, and said one of clothing care instructions and safety directions are readably oriented and readable in an open position against the background afforded thereto by said appearance imparting means.

30. An appliance door/lid as defined in claim 29 wherein said peripheral encapsulation includes at least two substantially opposite wall portions, one of said opposite wall portions includes a finger grip surface portion, and said hinge means is located opposite said finger grip surface portion.

31. The appliance door/lid as defined in claim 29 wherein at least one of said appearance imparting means and said printing means are heat-fusingly adhered to said respective glass panel inner surface and said appearance imparting means.

32. An appliance door/lid comprising a panel of substantially transparent tempered glass having a peripheral edge portion bordered by a frame defined at least in part by a peripheral encapsulation of synthetic polymeric/copolymeric material, said frame including a peripherally innermost edge portion defined by upper and lower walls bridged by a peripheral wall collectively defining a channel housing said glass panel peripheral edge portion, said glass panel including an outer surface and an inner surface, a substantially central area and a peripheral area between said substantially central area and said peripheral encapsulation, first means upon said glass panel inner surface of said peripheral area for imparting an appearance thereto ranging between substantially translucent to substantially opaque and establishing an edge defining an outer periphery of said substantially transparent central area through which clothing can be viewed when said door/lid is in a closed position with respect to a clothes opening of an associated appliance, second means upon said first appearance imparting means for imparting additional appearance thereto, printing means in the form of at least one of clothing care instructions and safety directions upon at least an exposed surface portion of said second appearance imparting means which are substantially indiscernible when viewed through said glass panel outer surface in said closed position, and said one of clothing care instructions and safety directions are readably oriented and readable in an open position against the background afforded thereto by said first and second appearance imparting means.

33. An appliance door/lid as defined in claim 32 wherein said peripheral encapsulation includes at least two substantially opposite wall portions, one of said opposite wall portions includes a finger grip surface portion, and said hinge means is located opposite said finger grip surface portion.

34. The appliance door/lid as defined in claim 32 wherein at least one of said appearance imparting means and said printing means are heat-fusingly adhered to said respective glass panel inner surface and said appearance imparting means.

* * * * *